United States Patent [19]
Bos
[11] 4,363,467
[45] Dec. 14, 1982

[54] FASTENING DEVICES FOR GUARDRAILS

[75] Inventor: Andre Bos, Toulouse, France
[73] Assignee: Technal International, France

[21] Appl. No.: 185,595
[22] Filed: Sep. 9, 1980
[30] Foreign Application Priority Data
Sep. 14, 1979 [FR] France ..... 79 23046
[51] Int. Cl.[3] ..... E04H 17/14; E04F 11/18
[52] U.S. Cl. ..... 256/68; 256/59; 256/65; 256/DIG. 6; 52/298; 52/704; 248/158
[58] Field of Search ..... 256/68, 69, 70, 59, 256/65, DIG. 6; 52/297, 298, 704, 584; 248/158

[56] References Cited

U.S. PATENT DOCUMENTS 2,954,638 10/1960 Motter ..... 52/298 X
4,059,934 11/1977 Hayamizu ..... 2/704 X

FOREIGN PATENT DOCUMENTS 778130 2/1968 Canada ..... 256/65
2250368 5/1975 France ..... 52/298
2293539 7/1976 France .
2303918 10/1976 France ..... 256/59
2322987 4/1977 France ..... 52/298
2341718 9/1977 France .

*Primary Examiner*—James Kee Chi
*Attorney, Agent, or Firm*—Larson and Taylor

[57] ABSTRACT

A guard rail comprising stiffening posts, a bottom rail and a top rail connecting the posts, is fastened to a building element, for instance a concrete slab, by a fastening device. The device comprises an anchor plate permanently secured to the building element and having an upper spherical support surface. A base plate has a lower support surface received by the support surface of the anchor plate. The upper portion of the base plate has a projecting collar which receives one of said posts in vertical position. The amount of horizontal offset of the collar is such that the posts and the bottom rail may be in contact with the building element.

7 Claims, 2 Drawing Figures

FASTENING DEVICES FOR GUARDRAILS

BACKGROUND AND SUMMARY OF THE INVENTION

The present invention relates to devices for fastening guardrails to building elements.

Guardrails typically comprise spaced posts connected by a top rail and a bottom rail forming structural elements and by filling elements limiting the size of the openings between the structural elements to a value such that there is no risk of falling. The filler elements may consist of parallel vertical bars, whose maximum spacing is fixed by standards.

A guardrail is generally secured to a building element, for example to a concrete slab. Conventional fastening devices belong to two types. A first approach consists of bedding stiffening posts designed to give sufficient bending strength in building elements, generally in the upper or front vertical surface of a slab. Another solution consists of securing anchor plates in the building and engaging the stiffening posts into the plates.

The first approach requires considerable labor time. The second approach results in the bottom rail being spaced from the building element by a space at least equal to the thickness of the plate, which should be substantial for reasons of mechanical strength. Consequently, there remains a gap whose width is sufficient to allow articles of a size such that their fall can endanger person and damage property, subsists, either above the slabs, or in front of the latter if the plate is secured to a slab front surface.

It is an object of the invention to provide an improved fastening device which is easily secured and assembled and makes it possible to locate the bottom rail at a height above the slab which is freely selected and may be quite small.

The device for fastening a guardrail including stiffening posts connected by a top rail and a bottom rail to a building element comprises an anchor plate constructed to be permanently secured to the building element and a base plate having a bearing surface cooperating with the anchor plate. The base has fastening means for a post; the amount of horizontal projection of the fastening means with respect to the anchor plate and the rest of the base plate is sufficient to permit the lower surface of the post to contact the building element and the bottom rail to be placed at any position between the building element and the fastening means. The fastening means may comprise a collar unitary with the base plate and through which the post projects and a wedge member for locking the post in the collar.

The invention is of particular advantage when the posts and rails are formed by light alloy sectional elements as described for instance in U.S. Pat. No. 3,411,752 (BOS). The stiffening posts will then generally be hollow tubes with a rectangular cross-section. Each collar can be formed with a passage for a post of a size corresponding to that of the post, having three vertical guiding surfaces and an inclined surface. The locking member for the post will then be a wedge insertable between the inclined surface and the post and whose force of insertion is adjustable by threaded means, such as a screw of which the head is retained in a chamber formed in the wedge member and which cooperates with a tapped bush fast with the stiffening post. Filler elements will advantageously be placed between the stiffening posts. These elements can be parallel bars or plates, for example of translucent plastics material or reinforced glass.

The invention will be better understood from a consideration of the particular embodiment given by way of example.

SHORT DESCRIPTION OF THE DRAWINGS

DETAILED DESCRIPTION OF A PREFERRED EMBODIMENT

Figure 1:
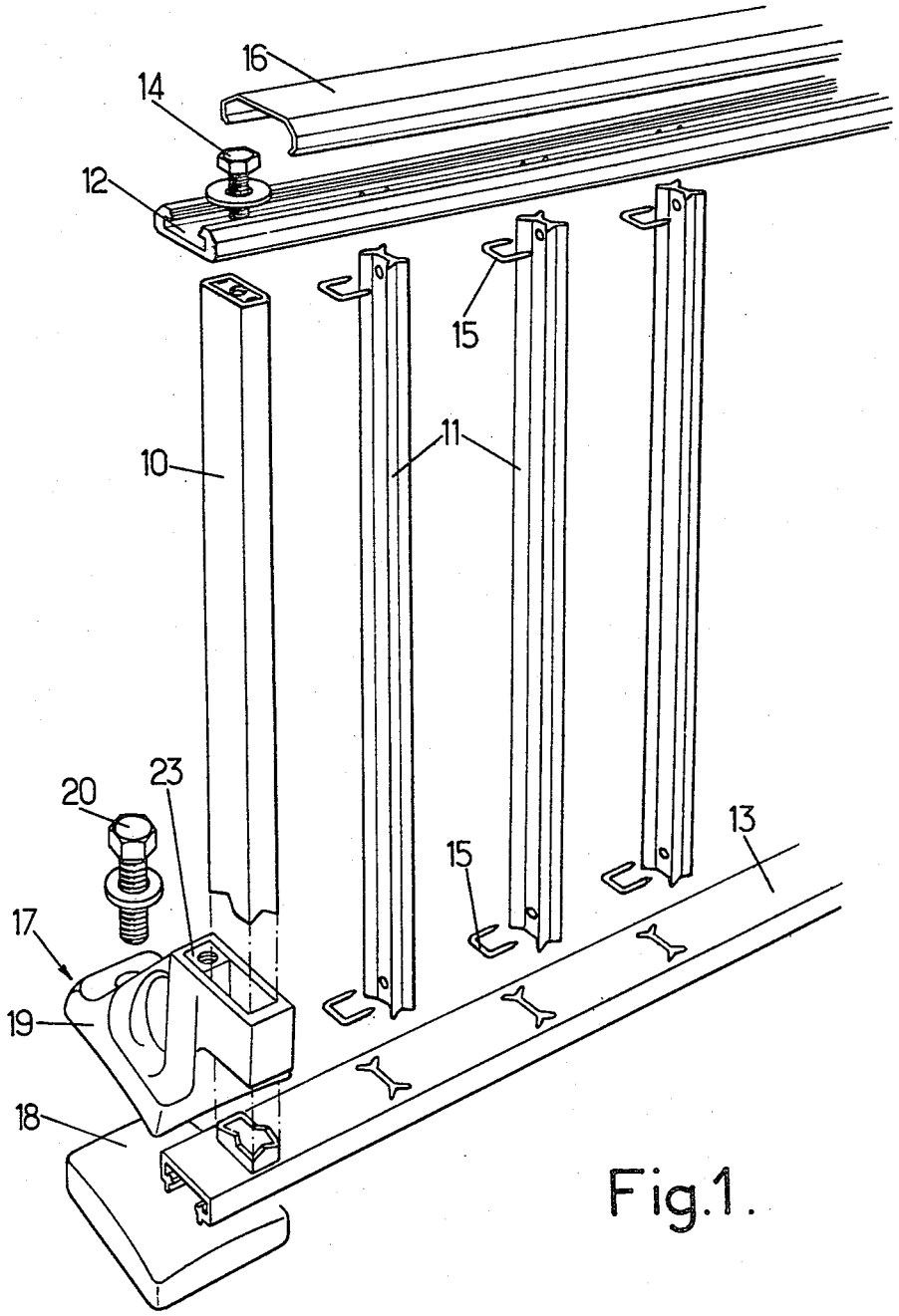
FIG. 1 is an exploded isometric view, showing the components of a particular guardrail and of a fastening device according to the invention for that guardrail.

Referring to FIG. 1, there is shown a guard rail which comprises stiffening posts 10 distributed at intervals, separated by bars 11, connected by a top rail 12 and a bottom rail 13. The posts, bars and rails are constituted by light alloy profiled sections. The stiffening posts 10 are in the form of tubes of rectangular cross-section. An insert received in the top part of each post 10 is designed to receive a fastening screw 14 for the top rail 12. The bars 11 are constituted by extruded profiled sections having a I -shaped cross-section. Openings of corresponding shape are formed in the top and bottom rails 12 and 13 to receive the end portions of the bars 11 which are then held in position by staple shaped fasteners 15. The rails 12 and 13 have a U-shaped cross-section and open upwardly and downwardly, respectively. The fastening staples are then hidden in the U. A hand rail 16 constituted by a profiled element is slidably engaged over the upper rail 12 and hides the screws 14 and the fastening staples 15. Such a construction is of the type disclosed in U.S. Pat. No. 3,411,752, to which reference may be made.

Each fastening device 17 comprises an anchor plate 18 permanently secured to a building element, shown diagrammatically in mixed lines, and a base plate 19. Dismountable fastening means, typically a screw 20 (FIG. 1), are provided to secure the base plate removably to the anchor plate.

Figure 2:
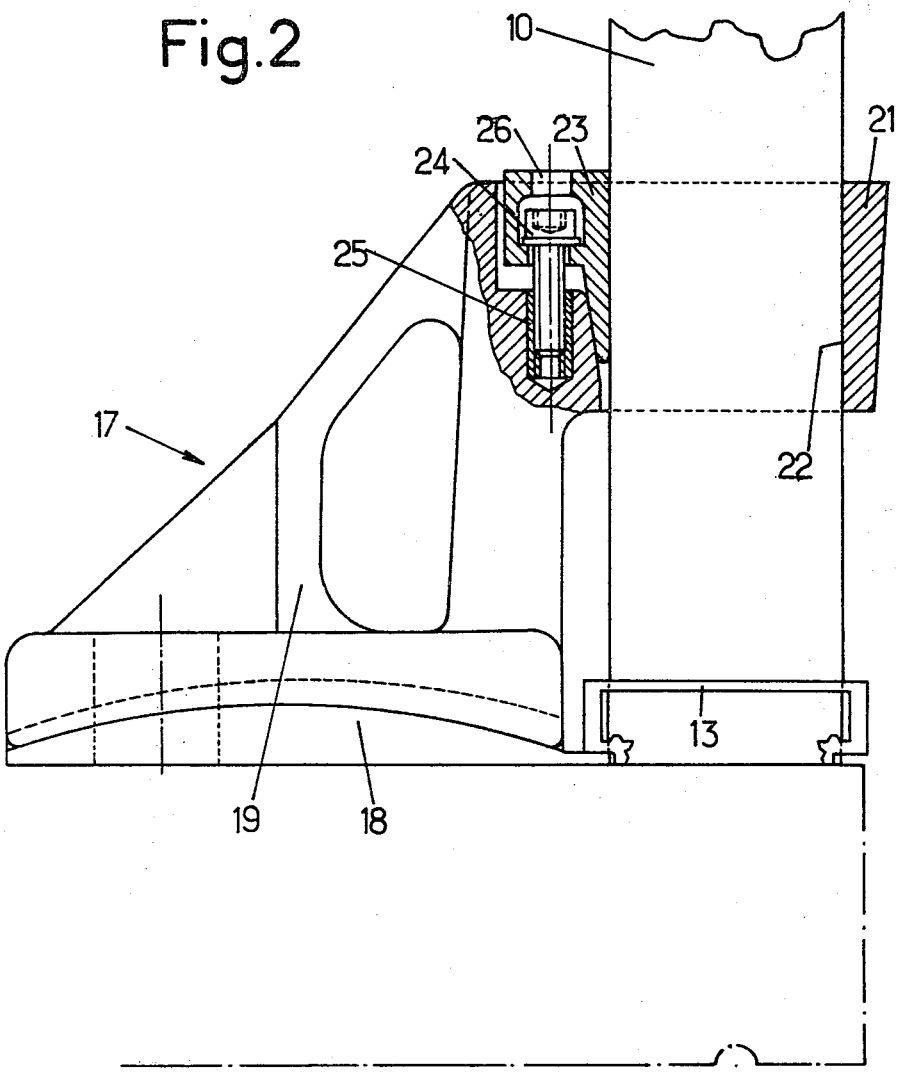
FIG. 2 is a detailed enlarged front view in partial cross-section through a vertical plane of the fastening device of FIG. 1.

The base plate 19 is constituted by a cast part, advantageously of light alloy like the profiled elements; as illustrated, plate 19 has a collar 21 projecting forwardly with respect to the rest of the base and in which a passage 22 is formed for receiving the post 10 in vertical position. Passage 22 has three vertical surfaces and an oblique rear surface. The distance between two confronting vertical surfaces corresponds to the width of the post, whereby the post may be slidably engaged in the passage. The amount of projection of the collar 21 with respect to the anchor plate 18 and to the rest of the base plate 19 is sufficient for the post 10 to be located forwardly of plates 18 and 19 and to engage the building element and for the lower rail 13 to be adjustable at any level between the building element (which it may contact as illustrated in FIG. 2) and the lower surface of the collar 21. An abutting projection is advantageously formed on the anchor plate (FIG. 2) or on the base plate to form a bearing surface retaining the foot of the stiffening post 10 and to increase the leverage of the torque resisting the bending torques exerted on the posts on use.

The base plate 19 is provided with a locking member 23 for locking the post 10 in the base member. As illustrated in FIGS. 1 and 2, member 23 is constituted by a wedge of such a size that it may be inserted between the oblique surface of passage 22 and the confronting vertical surface of post 10. A wedging effect is obtained by screwing a screw 24 borne by wedge 23 in a threaded bush 25 fast with the base plate. The head of the screw 24 may be retained in a chamber of the wedge, to avoid losing it. The screw illustrated in FIG. 2 includes an internal hexagonal blind hole which permits dismounting with a suitable tool introduced into the chamber through a hole of small dimensions 26.

The device is easily mounted: the various components are cut up at suitable lengths and the necessary openings are formed. The base plates are placed in position on the anchor plates. The bars 11 are mounted and fixed on the lower rail 13. The latter is adjusted in position. The stiffening posts 10 are then inserted. They are adjusted to be vertical by sliding the part spherical lower surfaces of the base plates 19 on the associated spherical upper surfaces of the anchor plates 13. The screws 20 are fully inserted for locking the base plates. The upper rail 12 is placed in position and fixed by screws 14 and staples 15. Finally, the hand rail 16 is fixed.

The invention is obviously not limited to the particular embodiment which has been described by way of example and it must be understood that the scope of the present patent extends to modifications remaining within the scope of the attached claims. It should further be understood that the words "guard rail" should be construed in a broad sense and include balcony balustrades, staircases guard rails and the like.

I claim:

1. A device for fastening a guard rail and the like to a building element, said guard rail having fastening posts and at least a bottom rail connecting the posts, said device comprising: an anchor plate constructed to be securable to the building element and having an upper support surface; a base plate having a lower support surface adapted to be received by said support surface of the anchor plate and having fastening means for retaining said fastening posts in vertical position, wherein said fastening means projects horizontally with respect to the anchor plate and to the rest of the base plate by an amount in excess of the size of said guard rail in the projecting direction and is located at a distance from said building element, whereby the post may be supported on the building element and the bottom rail may be placed at any level between the building element and said fastening means; and a locking member for locking said one post in said fastening means.

2. A device for fastening a guard rail and the like to a building element, said guard rail having stiffening posts and at least a bottom rail connecting the posts, said device comprising: an anchor plate constructed to be securable to the building element and having an upper support surface; a base plate having a lower portion formed with a downwardly directed support surface adapted to be received by said support surface of the anchor plate and having an upper portion formed with a collar unitary with the base plate, said collar being provided with a passage for receiving one of said posts in vertical position and projecting horizontally with respect to the anchor plate and the lower portion of the base plate by an amount sufficient to permit the foot of the post to be supported on the building element and to place said bottom rail at any level between the building element and said collar; and a locking member for locking said one post in said collar.

3. A fastening device according to claim 2, wherein the aperture formed in said collar for receiving said one post has a rectangular cross-section with three vertical surfaces and an inclined surface and said locking member is constituted by a wedge insertable between the inclined surface and a confronting vertical surface of the post, whose cross-sectional corresponds to the minimum cross-section of the aperture, threaded means being provided to force the wedge between said inclined surface and said post.

4. A fastening device according to claim 3, wherein the threaded means are constituted by a screw whose head is imprisoned in the wedge and which cooperates with a threaded bush fast to the base plate.

5. A fastening device according to claim 1, or 2, wherein said base plate or anchor plate includes a projection for retaining the foot of the post.

6. A fastening device according to claim 2, wherein the support surfaces of the base plate and of the anchor plate are spherical.

7. A guard rail comprising a fastening device according to claim 5, wherein said bottom rail is a U-shaped extruded section opening downwardly, having openings whose cross-section is proportioned to the cross-section of said posts and said projection is proportioned to the shape of the bottom rail for the latter to be vertically adjustable in contact with the building element.

* * * * *